United States Patent [19]

Gotou et al.

[11] Patent Number: 4,790,804

[45] Date of Patent: Dec. 13, 1988

[54] BAG MANUFACTURING APPARATUS

[75] Inventors: Toyokichi Gotou, Souka; Masami Fujishiro, Tama, both of Japan

[73] Assignees: Newlong Machine Works, Ltd.; New Pack Company, Ltd., both of Tokyo, Japan

[21] Appl. No.: 10,583

[22] Filed: Feb. 3, 1987

[30] Foreign Application Priority Data

Feb. 7, 1986 [JP] Japan ..... 61-16357[U]

[51] Int. Cl.[4] ..... B31B 33/86; B65H 45/16

[52] U.S. Cl. ..... 493/226; 493/243; 493/386; 493/424; 493/426; 493/432

[58] Field of Search ..... 493/226, 243, 379, 386, 493/424, 425, 426, 427, 428, 429, 432

[56] References Cited

U.S. PATENT DOCUMENTS

| | | | |
|---|---|---|---|
| 458,008 | 8/1891 | Winship | 493/444 |
| 2,775,171 | 12/1956 | Steen et al. | 493/226 |
| 2,950,105 | 8/1960 | Berry | 493/426 |
| 3,590,696 | 7/1971 | Reissner et al. | 493/226 |
| 3,613,523 | 10/1971 | Wesselmann | 493/226 |
| 3,818,811 | 6/1974 | Kleinhaut | 493/226 |

FOREIGN PATENT DOCUMENTS

| | | | |
|---|---|---|---|
| 2647835 | 4/1978 | Fed. Rep. of Germany | 493/424 |
| 27622 | 2/1976 | Japan . | |

*Primary Examiner*—Frederick R. Schmidt
*Assistant Examiner*—William E. Jerrell
*Attorney, Agent, or Firm*—Lowe, Price, Leblanc, Becker & Shur

[57] ABSTRACT

A lapel provided at the one end of a paper sheet to forming a paper bag is introduced into the interior of an opening on the rotary cylinder by means. The folding blade has a rotational axis located outside the rotary cylinder parallel to an axis of rotation of the rotary cylinder. The thus bent lapel is brought in pressure contact with the edge face of the opening by means of a holding pawl which turns in operative association with the rotary cylinder. Thereafter, the lapel is covered and depressed by means of a depressing pawl which turns in operative association with the rotary cylinder whereby the lapel and a part of the paper sheet are adhesively secured to one another to build a double-walled structure around the opening of the paper bag.

9 Claims, 6 Drawing Sheets

BAG MANUFACTURING APPARATUS

SUMMARY OF THE INVENTION

The present invention relates to a folding apparatus usable for producing bags such as portable paper bags and more particularly to improvement in a folding apparatus which assures that the operations for folding a lapel extending around an upper edge of the bag opening to establish a double-walled thickness at the upper edge thereof is performed automatically.

Because the upper edge part around the opening of a portable paper bag is very susceptible to injury or breakage by articles which are repeatedly contained therein and taken out therefrom, there is a proposal for reinforcing the upper edge part of the paper bag by providing a lapel 2 therearound. The upper edge part of the opening is folded inwardly to build a double-walled structure in such a manner that the lapel 2 is formed with a plurality of cutouts 2*a* through which a hand-carrying cord 3 extends and bridge pieces 4 for the cords 3 are interposed between the lapel 2 and the upper end part of a paper sheet 5 forming the bag (FIG. 11).

A typical conventional apparatus for automatically performing a folding operation is disclosed in an official gazette of Japanese Utility Model Laid-Open NO. 27622/1976.

The conventional apparatus is schematically illustrated in FIG. 10. Specifically, the apparatus is so constructed that a rotary cylinder 31 has an opening portion 36 formed in both the circumferential and axial directions. A holding pawl 32 is adapted to be reciprocably turned by means of a roller 33 which in turn moves in accordance with the contour of a cam 35 and is disposed within the opening 36. A folding pawl 37 for folding the lapel 2 at the one end of the paper sheet 5 is movably supported outside the rotary cylinder 31. Folding of the lapel 2 is carried out by way of the steps of placing the lapel 2 with an assembly of the hand-carrying cord 3 and the bridge piece 4 attached thereto on the rotary cylinder 31, pushing down the lapel 2 by turning movement of the folding pawl 37, and at the same time firmly holding the thus bent lapel 2 by means of the holding pawl 32 and finally folding it onto the paper sheet 5 by another turning movement of the folding pawl 37 so as to allow the lapel 2 and the paper sheet 5 to be adhesively secured to one another.

However, a problem occurs in that the lapel 2 occasionally fails to be held by means of the holding pawl 32 because it is difficult to introduce the lapel 2 into the interior of the opening portion 36 on the rotary cylinder 31 in a reliable manner. Further, due to the fact that a bag produced with the use of the conventional apparatus has no lapel at the position where a hand-carrying cord extends and thereby extension of the holding pawl 32 is interrupted at the aforesaid position, another problem is that folding can not be exactly effected at the position where a double-walled structure is built at small lapel portions 2*b* as shown in FIG. 1, when a bag of the type including the small lapel portions 2*b* in that way is produced by operating the conventional apparatus.

Hence, the present invention has been made with the foregoing background in mind and its object resides in providing a folding apparatus usable, for instance, for an automatic portable paper bag production line which assures that a lapel is firmly held over its whole area by means of a holding pawl in the opening portion of a rotary cylinder, the holding pawl inhibits a paper sheet constituting a paper bag from being displaced away from a predetermined position, the lapel and a part of the paper sheet are adhesively secured to one another and folding of the lapel is effected exactly.

Another object of the present invention is to provide a folding apparatus of the above-mentioned type which assures that the whole lapel to be extended around the upper edge of the opening of a bag is automatically folded without fail, while building a double-walled structure.

Another object of the present invention is to provide a folding apparatus of the above-mentioned type which assures that production of products to be rejected is prevented reliably and thereby production of products to be accepted is carried out without an occurrence of increase in production cost.

To accomplish the above objects there is proposed according to the present invention a folding apparatus usable for producing portable paper bags comprising a rotary cylinder having an opening portion formed thereon in both the circumferential and axial directions, a folding blade adapted to turn about an axis which is located outside the rotary cylinder in parallel with an axis of the rotary cylinder, the foremost edge part of the folding blade being introduced into the interior of the opening portion on the rotary cylinder, a holding pawl disposed to come in contact with and be parted away from the edge face of the opening portion, the holding pawl being turned in operative association with the rotary cylinder, and a depressing pawl disposed to be projected through the opening portion to cover a part of the circumferential surface of the rotary cylinder adjacent to the edge face of the opening portion located opposite to the holding pawl, the depressing pawl being turned in operative association with the rotary cylinder.

In a preferred embodiment the folding blade is formed with a plurality of cutouts through which a hand-carrying cord extends.

Both the holding pawl and the depressing pawl are movably supported in the rotary cylinder.

Other objects, features and advantages of the present invention will become readily apparent from reading of the following description which has been prepared in conjunction with the accompanying drawings.

BRIEF DESCRIPTION OF THE DRAWINGS

The accompanying drawings will be briefly described below.

DESCRIPTION OF THE PREFERRED EMBODIMENT

The present invention will now be described in a greater detail with reference to the accompanying drawings which illustrate a preferred embodiment thereof.

Figure 1:
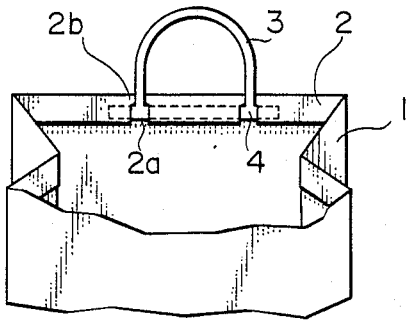
FIG. 1 is a fragmental perspective view of a portable paper bag produced by operating the apparatus of the invention.
Figure 2:
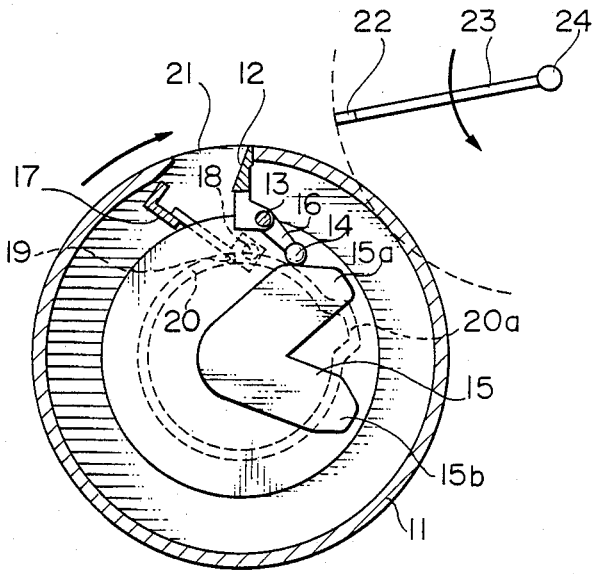
FIG. 2 is a schematic cross-sectional view of the apparatus in accordance with an embodiment of the invention.

Refering to FIG. 2, a rotary cylinder 11 is provided with an opening portion 21 which is formed in both the circumferential and axial direction and a holding pawl 12 of which a foremost end part is normally urged into pressure contact with the whole edge face of the opening portion 21 under the effect of resilient force of spring means is supported in the rotary cylinder 11 for rotation of the pawl shaft 13. The holding pawl 12 includes a roller 14 which is connected to the rotational shaft 13 via a connecting arm 16. The roller 14 comes in pressure contact with a cam 15 under the effect of resilient force of spring means so that it is displaced in the radial direction of the rotary cylinder 11 in accordance with the contour of the cam 15. In response to radial displacement of the roller 14 the holding pawl 12 is caused to reciprocably move whereby it is displaced toward or away from the edge face of the opening portion 21 on the rotary cylinder 11.

Further, a depressing pawl 17 is supported in the rotary cylinder 11 to turn about a rotational shaft 18 which is fixedly mounted on the rotary cylinder 11. The depressing pawl 17 has a roller carried thereon which is adapted to move in accordance with the contour of a cam groove 20. As the roller 19 is displaced in the radial direction of the rotary cylinder 11 by means of the cam groove 20, the depressing pawl 17 is caused to turn about the rotational shaft 18 so that it is projected through the opening portion 21 outwardly of the rotary cylinder 11 to come in contact with a part of the circumferential surface of the rotary cylinder 11 from the edge face side of the opening portion 21.

Further, the apparatus is provided with a folding blade 22 in the form of a plate in the area located outside the rotary cylinder in such a manner that it turns about a rotational shaft 24 disposed in parallel with the rotary cylinder 11 so as to allow its foremost end to enter into the interior of the opening portion 21. As is apparent from the drawing, the folding blade 22 is carried by means of a holder 23 which is operatively connected to the rotational shaft 24.

Next, operation of the apparatus as constructed in the above-described manner will be described below.

Figure 3:
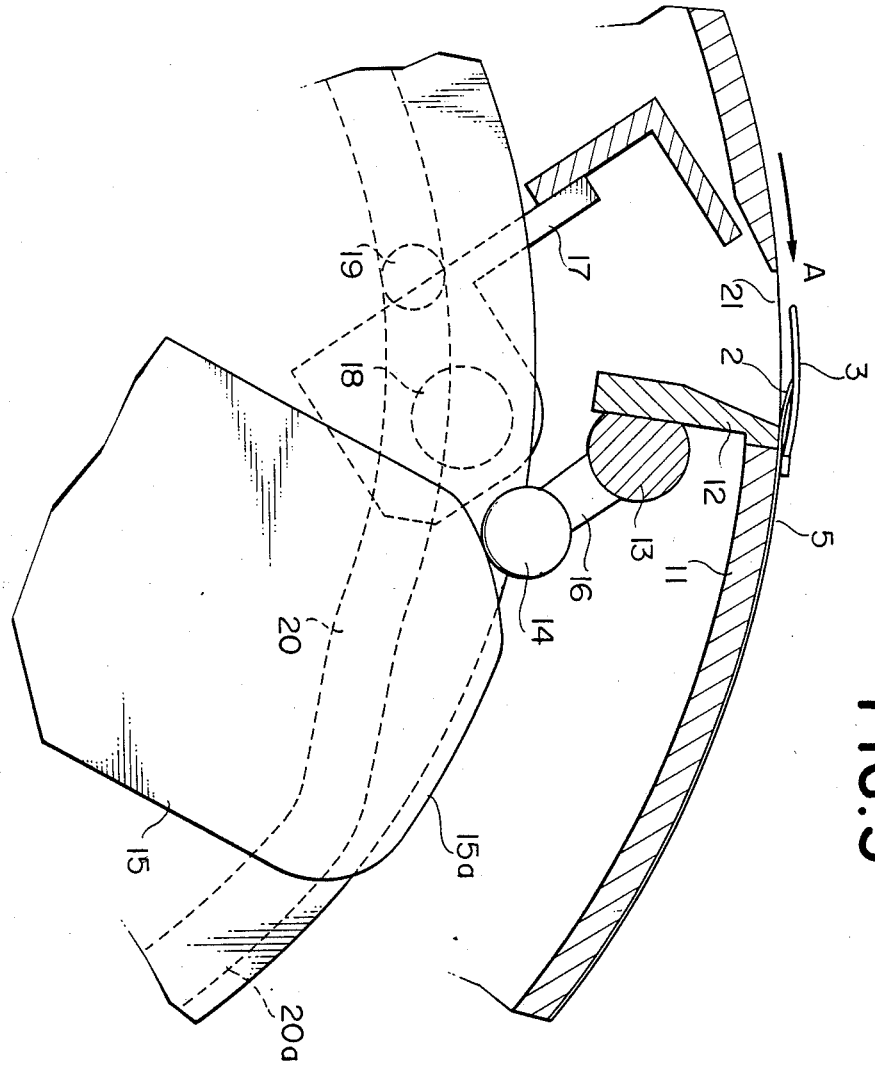
FIGS. 3, 4 and 6 are a fragmental cross-sectional view of the apparatus in FIG. 2, particularly illustrating actuation of essential components in the apparatus.
Figure 8:
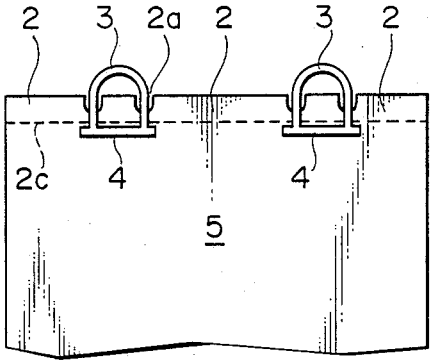
FIG. 8 is a plan view of a paper sheet constituting a paper bag, showing the state before folding is effected.

First, a paper sheet of which shape is shown in FIG. 8 is transferred onto the rotary cylinder 11. Then, the paper sheet 5 with bridge pieces 4 for hand-carrying cords 3 attached thereto is placed on the rotary cylinder 11 rotating in the direction as identified by arrow A in FIG. 3 in such a manner that a lapel 2 to be substantially folded is located above the opening portion 21 of the rotary cylinder 11. At this moment the holding pawl 12 comes in pressure contact with the edge face of the opening portion 21 of the rotary cylinder 11, while depressing pawl 17 stays within the rotary cylinder 11. As the rotary cylinder 11 is rotated, the roller 14 rolls on the cam 15 toward a first projected part 15*a*, and the roller 19 moves along the cam groove 20 toward a projected part 20*a*, the holding pawl 12 turns to come in contact with the edge face of the opening portion 21, and the depressing pawl 17 is located away from the edge face of the opening portion 21.

Figure 4:
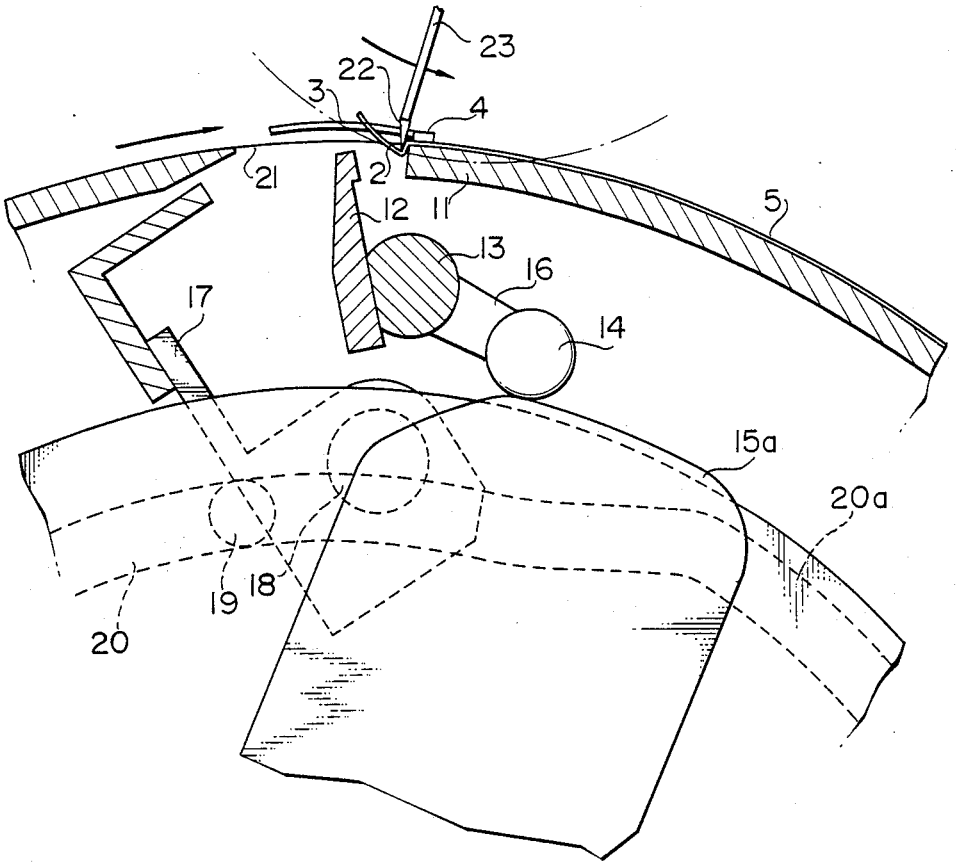
Figure 5:
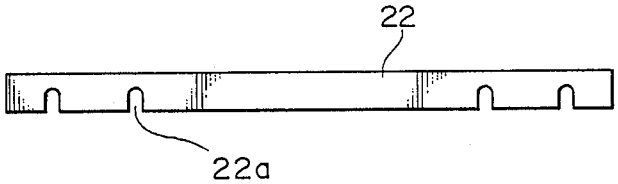
FIG. 5 is a plan view of a folding blade.
Figure 6:
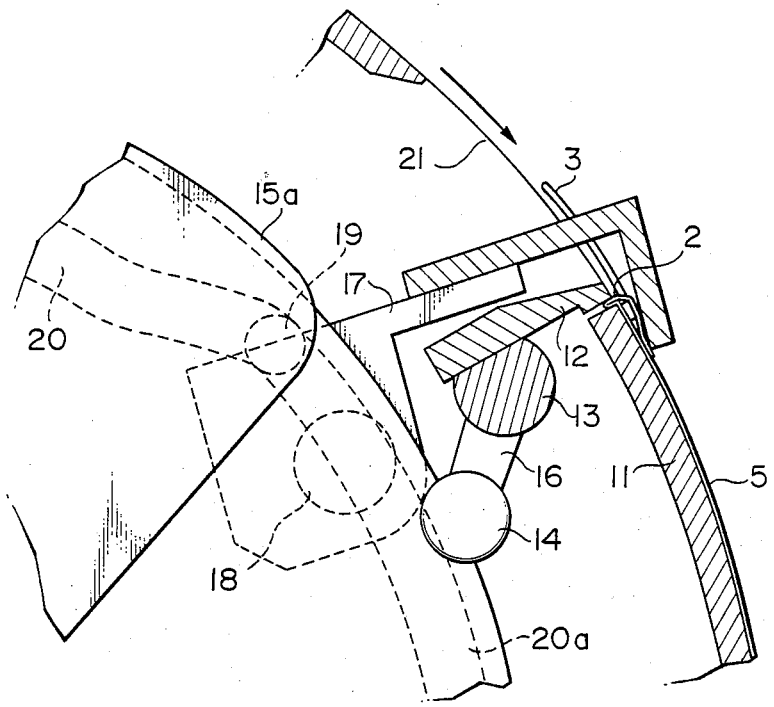

When the roller 14 reaches the first projected part 15*a* of the cam 15 as shown in FIG. 4 as the rotary cylinder 11 continues to be rotated, the holding pawl 12 is parted away from the edge face of the opening portion 21 and the folding blade 22 carried by the holder 23 is introduced into the space as defined between the holding pawl 12 and the edge face of the opening portion 21 to push the lapel 2 into the interior of the opening portion 21 until the lapel 2 engages to the edge face of the opening portion 21. It should be noted that the circumferential speed of the foremost end of the folding blade 22 is determined appreciably higher than that of the rotary cylinder 11. As shown in FIG. 5, the folding blade 22 is formed with a plurality of cutouts 22*a* through which a hand-carrying cord 3 extends.

Figure 7:
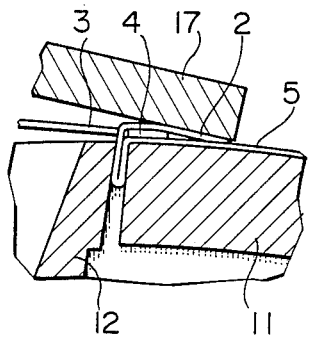
FIG. 7 is an enlarged fragmental sectional view of a part of the apparatus in FIG. 6.

Further, as cylinder 11 continues to be rotated, the roller 14 moves past the first projected part 15*a* of the cam 15 This causes the holding pawl 12 to be displaced again toward the edge face of the opening portion 21 of the rotary cylinder 11 while the folding blade 22 is parted away therefrom, whereby the lapel 2 is folded along a folding line as shown in FIG. 8 in such a state that it is clamped between the holding pawl 12 and the edge face of the opening portion 21. At this moment the roller 19 reaches the projected part 20*a* of the cam groove 20 so that the depressing pawl 17 is projected through the opening portion 21 to cover a part of the circumferential surface of the rotary cylinder 11 located adjacent to the edge face of the opening portion 21. Thus, the depressing pawl 17 inhibits the folded lapel 2 from being parted away from the rotary cylinder 11. Moreover, it bends the upright standing end part of the lapel 2 toward the paper sheet 5 and thereafter the aforesaid end part is depressed onto the paper sheet 5 thereby, as shown in FIG. 7. Since a part of the paper sheet 5 or the lapel 2 is previously coated with glue, the paper sheet 11 and the lapel 2 are adhesively secured to one another at this time. Further, since the depressing pawl 12 is brought in pressure contact with the whole area of the end part of the opening portion 21, the double walls at the upper part 2*b* of the folded lapel 2 are reliably glued together while the bridge pieces 4 of the hand-carrying cords 3 are held therebetween. As the rotary cylinder 11 is rotated further, the roller 14 reaches a second projected part 15*b* of the cam 15, causing the holding pawl 12 to be parted away from the opening portion 21 of the rotary cylinder 11. At this moment the roller 19 moves past the projected part 20*a* of the cam groove 20 and thereby the depressing pawl 17 is displaced into the interior of the rotary cylinder 11 again.

Figure 9:
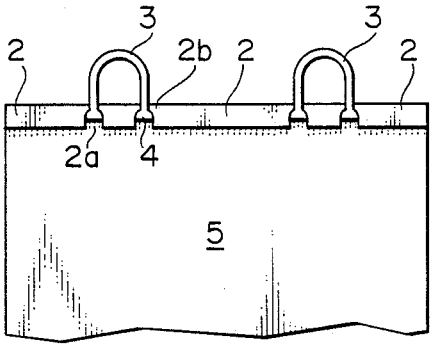
FIG. 9 is a plan view of the paper sheet in FIG. 8, showing the state after completion of folding operation.
Figure 10:
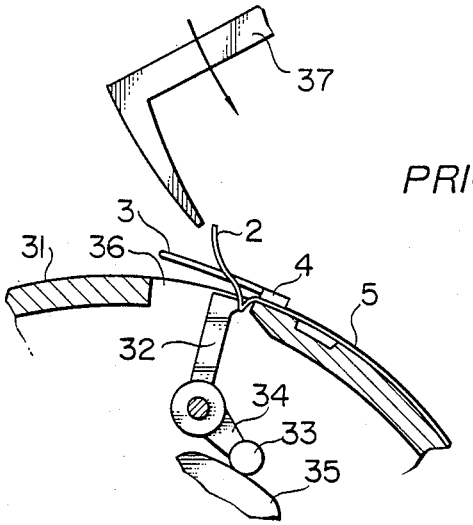
FIG. 10 is a schematic cross-sectional view of a conventional folding apparatus.
Figure 11:
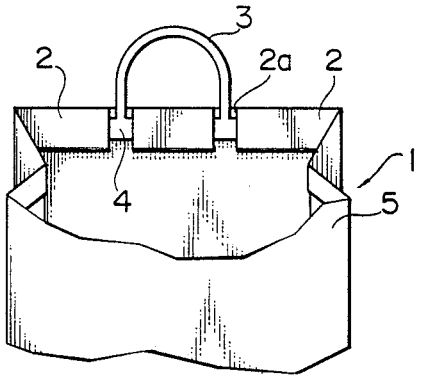
FIG. 11 is a fragmental perspective view of a conventional paper bag similar to FIG. 1.

Thereafter, the lapel 2 on the paper sheet 5 is subjected to pressing further by means of a pressing roller (not shown) and after completion of pressing operation an assembly of the paper sheet 5, the lapel 2 and the hand-carrying cords 3 as shown in FIG. 9 leaves the rotary cylinder 11 to be delivered to the next step of processing.

Incidentally, other steps of processing can be carried out with the use of an automatic folding apparatus as disclosed, for instance, in an official gazette of Japanese Laid-Open NO. 27622/1976 to automatically produce portable paper bags of which upper part around the opening has a double-walled structure.

While the present invention has been described above only with respect to a single preferred embodiment thereof, it should of course be understood that it should not be limited only to this but various changes or modifications may be made in any acceptable manner without departure from the spirit and scope of the invention as defined by the appended claims.

What is claimed is:

1. A folding apparatus for folding an edge part on a paper sheet to form a lapel of double thickness on an open end of a bag made from said sheet comprising:

a rotary cylinder having an opening formed thereon extending in both circumferential and axial directions of the cylinder, said paper sheet disposed on said cylinder with said edge part overlying said opening, a folding blade rotatable about an axis located outside said rotary cylinder and generally parallel with an axis of rotation of the rotary cylinder, and means for moving part of said folding blade into said opening on the rotary cylinder so that said folding blade contacts to direct said edge part into said opening, a holding pawl movable towards and away from an edge face of the opening for engagement with a folded portion of said edge part, and means for moving said holding pawl in operative association with the rotary cylinder towards the edge face to exert pressure contact against said folded portion of said edge part bearing against the edge face, and a depressing pawl positioned to project through the opening to cover a part of the outer circumferential surface of the rotary cylinder adjacent the edge face of the opening located opposite to the holding pawl to exert pressure contact against a free end of the edge part projecting out of the opening from the folded portion, and means for moving said depressing pawl in operative association with the rotary cylinder to exert said pressure contact.

2. A folding apparatus as defined in claim 1, wherein the lapel of double thickness is formed with a plurality of cutouts through which a hand-carrying cord extends and bridge pieces of the cords are interposed between the lapel and the paper sheet forming the wall of the bag wherein the folding blade is formed with a plurality of cutouts through which the hand-carrying cord extends when the folding blade is introduced into the opening, said cutouts being substantially coplanar with the rotational axis of the folding blade.

3. A folding apparatus as defined in claim 1, wherein the holding pawl is turnably supported in the rotary cylinder.

4. A folding apparatus as defined in claim 3, wherein the means for moving the holding pawl includes a cam, wherein the holding pawl includes a roller which is connected thereof via a connection arm, said roller coming in pressure contact with said cam under the effect of resilient force of spring means.

5. A folding apparatus as defined in claim 4, wherein said cam has a first projected part and a second projected part.

6. A folding apparatus as defined in claim 1, wherein the depressing pawl includes a roller which is adapted to move in accordance with the contour of a cam groove.

7. The folding apparatus of claim 1, wherein portions of said edge part establishing the lapel of double wall thickness are adhesively secured to each other by pressure contact exerted by said holding pawl and depressing pawl.

8. A folding apparatus for folding an edge part on a paper sheet to form as lapel of double thickness on an open end of a bag made from said sheet, comprising:

a rotary cylinder having an opening formed thereon in both circumferential and axial directions of the cylinder, said paper sheet disposed on said cylinder with said edge part overlying said opening;

a folding blade rotatable about an axis located outside said rotary cylinder and generally parallel with an axis of rotation of the rotary cylinder, said folding blade being formed with a plurality of cutouts; and means for moving said folding blade into the interior of said opening to direct said edge part into said opening;

a holding pawl movable towards and away from an edge face of the opening for engagement with a folded portion of said edge part, and means for moving said holding pawl in operative association with the rotary cylinder towards the edge face to exert pressure contact against said folded portion of said edge part bearing against the edge face; and a depression pawl positioned to project through the opening to cover a part of the outer circumferential surface of the rotary cylinder adjacent the edge face of the opening to exert pressure contact against a free end of the edge part projecting out of the opening from the folded portion, and means for moving said depressing pawl in operative association with the rotary cylinder to exert said pressure contact.

9. The folding apparatus of claim 8, wherein said lapel is formed with a plurality of cutouts through which a hand-carrying cord extends and bridge pieces of the cords are interposed between the lapel and the paper sheet forming the wall of the bag, said folding blade cutouts being aligned with the cords to prevent contact therewith as the folding blade is introduced into the opening to move the lapel through the opening.

* * * * *